US005711399A

United States Patent [19]

Wayne-Prejean

[11] Patent Number: 5,711,399

[45] **Date of Patent: *Jan. 27, 1998**

[54] PORTABLE HUNTER'S LADDER

[76] Inventor: L. Wayne-Prejean, 291 Tanner Rd., Searcy, Ark. 72143

[ * ] Notice: The term of this patent shall not extend beyond the expiration date of Pat. No. 5,509,499.

[21] Appl. No.: 634,585

[22] Filed: Apr. 18, 1996

Related U.S. Application Data

[63] Continuation of Ser. No. 297,245, Aug. 25, 1994, Pat. No. 5,509,499, which is a continuation-in-part of Ser. No. 93,006, Jul. 19, 1993, abandoned.

[51] Int. Cl.[6] ..... E06C 1/10

[52] U.S. Cl. ..... 182/93; 182/187

[58] Field of Search ..... 182/93, 116, 187

[56] References Cited

U.S. PATENT DOCUMENTS

| | | | |
|---|---|---|---|
| 1,280,456 | 10/1918 | Harmon | 182/194 |
| 2,187,286 | 1/1940 | Tillman | 182/194 |
| 4,492,286 | 1/1985 | Lemire | 182/934 |
| 5,277,273 | 1/1994 | Grimes | 182/194 X |
| 5,509,499 | 4/1996 | Prejean | 182/187 |

*Primary Examiner*—Alvin C. Chin-Shue
*Attorney, Agent, or Firm*—David L. Ray

[57] ABSTRACT

A portable, hunter's ladder, useful in climbing trees comprising a pair of tubular rails radiused at each end forming a generally "C-shaped" configuration with their ends turned at oblique angles towards each other. A plurality of rungs, spaced along the rail's length, hold the rails in a substantially parallel relationship and are spaced at regular intervals except for the uppermost rung which is placed adjacent the upper, rail radius leaving an unequal spacing between the upper two rungs. Thus providing the climber with a better footing advantage when traversing around a tree to avoid limbs or when transferring to another ladder or tree stand.

6 Claims, 14 Drawing Sheets

PORTABLE HUNTER'S LADDER

CROSS-REFERENCE TO RELATED APPLICATIONS

This application is a continuation of application Ser. No. 08/297,245 filed Aug. 25, 1994, now allowed, U.S. Pat. No. 5,509,499, issued Apr. 23, 1996, which is a continuation-in-part of application Ser. No. 08/093,006 filed Jul. 19, 1993, now abandoned.

BACKGROUND OF THE INVENTION

1. Field of the Invention

The present invention relates to ladders in general and more particular to portable ladders used by hunters.

2. General Background

It is often necessary for hunters to seek elevated locations for spotting potential game, or for simply improving their vantage point. Therefore, it is customary for the hunter to use tree stands to provide some degree of comfort during the long hours spent waiting for game to come along. Climbing trees can be very difficult and is made more difficult when trying to haul equipment such as a tree stand and weapons to any significant height.

To assist the hunter in climbing trees, a ladder has become necessary and is usually packed into the forest by the hunter along with the tree stand. Therefore, various types of ladders have been employed which will provide ease of climbing and are light enough to make them practical to carry. Most ladders employed for this purpose have "stand-off" arrangements which provide adequate space for the climber's foot between the tree and the rungs of the ladder. They also have a rope or cable to secure the ladder to the tree and are usually supported by the ground, hung from limbs, or simply propped against the tree. Examples of these arrangements can be seen in U.S. Patents to Woller U.S. Pat. No. 4,991,690, and Dunn U.S. Pat. No. 5,016,732. In addition, pole ladders have been devised which utilize a single pole. Such pole ladders are usually extendable and have steps on either side as more clearly depicted in U.S. Patents to Strickland U.S. Pat. No. 5,040,635 and Andrews, et al. U.S. Pat. No. 4,762,200.

Ladders of these types have proven to be bulky, heavy, and unsafe. Therefore, the search continues for a lightweight portable ladder which overcomes the problems associated with these types of ladders.

SUMMARY OF THE PRESENT INVENTION

It has always been assumed that a hunting ladder must be continuous from ground level to tree stand. This has been exemplified by the use of extensions added to the base ladder to increase its height. This makes most hunting ladders cumbersome and bulky due to multiple extensions and their excessive length. The present invention shows that a very simple, very short, lightweight, ladder which does not require multiple ropes or cables to secure it to the tree. A single rope or belt is all that is required. The present invention can be defined as a lateral bar ladder having very narrow gage rails, usually less than ten inches apart. It has been found that a ladder length of approximately three and one-half to four feet is sufficient. If the tree stand is to be placed at a higher level than can be achieved by using a single ladder, a pair of ladders can be used which still weigh less than most extension ladders. In addition, the instant invention allows the hunter to ascend to the level of a tree stand and, while standing on the stand, remove and reposition the ladder or attach a second ladder to the tree trunk above the stand to attain a higher level, allowing the hunter to reposition the tree stand at an even higher level and repeat the process.

Various embodiments have been developed to achieve the desired result. At first, a conventional box tubing rail and rung design was employed utilizing various stand-off configurations which were welded to the box tube frame. Such stand-offs consisted of both fabricated pieces and sections cut from extruded members. Although these early designs proved effective, their construction was still labor intensive. Alternative stand-off arrangements such as retractable legs were also devised.

A simpler design was discovered which utilized a round, oval or other irregular shaped hollow tubes, and a twin rail design with structural right-angle shaped rungs with one rung spaced at an irregular interval near the top. It was found that irregular spacing was an important aspect of the invention, allowing the hunter to ascend the ladder to its most secure position at or near the retaining rope or cable, whereby both feet are close together but on different rungs, facilitating the stepping from ladder to ladder, to a limb or tree stand without upsetting the ladder. The preferred embodiment reduces weight by providing a radius at each end of the rail members which produces the proper stand-off distance. By rotating the bent rail ends towards each other, it was found that additional structural lateral bracing was not required, thereby further reducing the weight requirement.

It has also been discover that by attaching the flexible attachment rope or belt to the ladder at a point slightly above the mid-point of the ladder, flexing of the ladder frame occurs when weight is placed on the ladder resulting in tensioning of the ladder against the tree thus spring loading the ladder relative to the tree even when the weight is removed.

Various options utilizing the preferred embodiment are also achievable. First, there is provided a flexible stirrup fabricated from a rope fastened around each of the side rails and secured to each side rail above the lower rung. This stirrup comprises a tubular sleeve slipped over the rope, forming a foot rung. Next, a telescopic arrangement can be provided which would allow the ladder to be extended for use while maintaining its original length during travel. An auxiliary telescopic joint could also be added to extend the length of the ladder. Another embodiment calls for the invention to consist of two pieces, an upper and lower section which are inter-lockable by simply skewing and inserting the lower section between the rails of the upper section and returning it to its original parallel alignment. This arrangement also makes the lower section adjustable by inserting a set of pins. By employing the same radiused rail stand-off principle, a short single rail ladder with side steps has also been developed.

In recent years, the U.S. Forestry Commission has tried to discourage the use of steps or climbing devices which mar the trees, leaving deep cuts and gouges. Therefore, various protective caps have been developed for the present invention to prevent such marking. Although the present invention utilizes the same suspended or cantilevered principle as that employed by tree stands, it was found that only one rope or cable attachment per ladder was necessary, regardless of height on the tree. Therefore, various options for securing the ladder to the tree were developed the most common being the rope and snap hook type which also employs a cinch sleeve. However, a more preferable and secure latch would be the security chain latch arrangement commonly used on doors. Either the hook or chain latch in combination with a rope cinch sleeve provides a secure means for locking the ladder to any size tree.

Several embodiments have been developed to provide for compactability and portability while still being ultra lightweight and structurally safe. Such embodiments include telescopic inserts, interlocking components, folding legs, and flexible stirrups.

In view of the above disclosure, it is an object of the present invention to provide a hunting ladder which is strong, lightweight and compactable so as not to be an obstruction when backpacked through heavy brush.

It is a further object of the present invention to provide a hunting ladder means which does not mar the trunk of a tree.

Still another object of the present invention is to provide a pair of light weight hunting ladders which when used in combination allows the hunter to ascend the tree by suspending one ladder from the tree's trunk and while standing on the first ladder attach the second ladder and ascend to its highest level. This combination allows the hunter to avoid lower limbs by spiraling around the tree.

It is still a further object of the present invention to provide a hunters ladder which does not depend on the ground for support.

Figure 26:
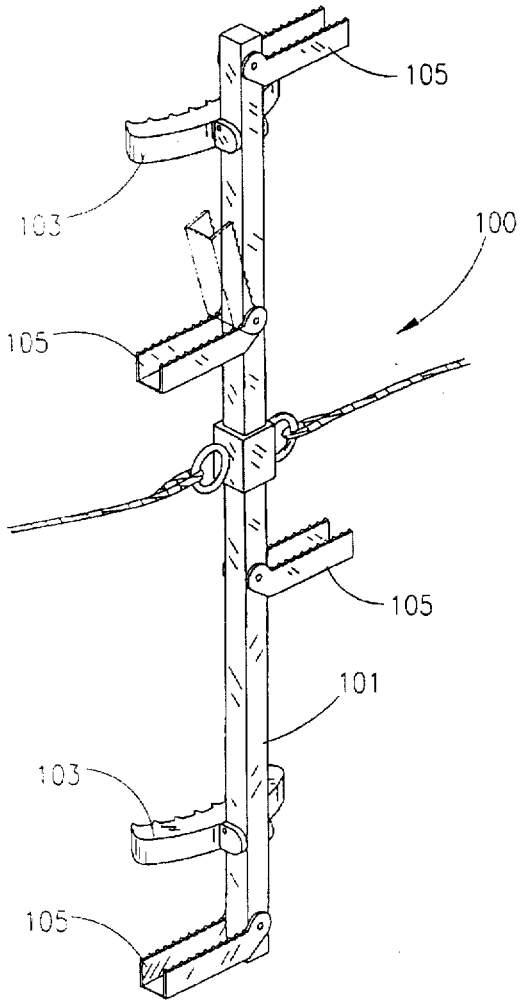
FIG. 26 is an isometric view of an alternate single rail ladder embodiment having folding serrated steps and stand off legs.
Figure 27:
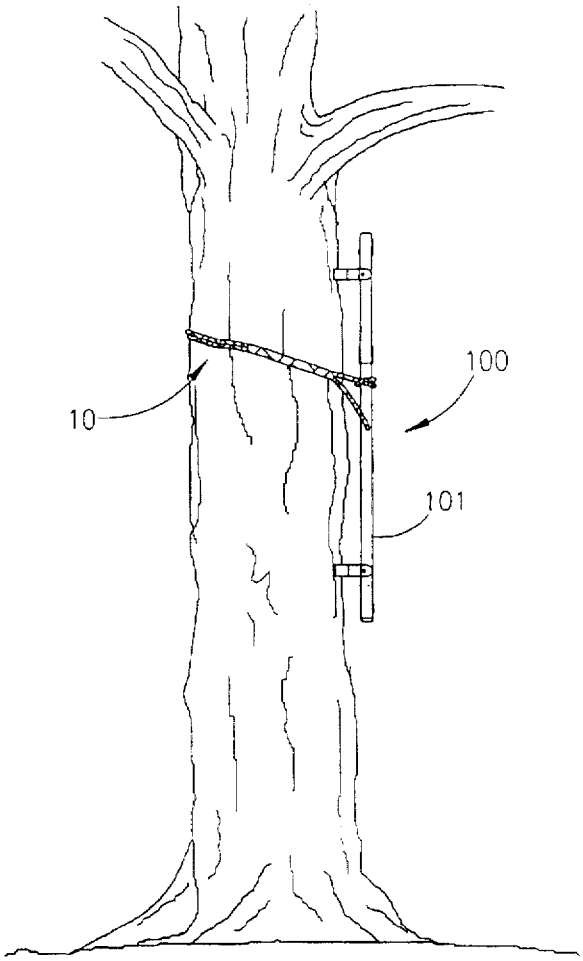
Figure 28:
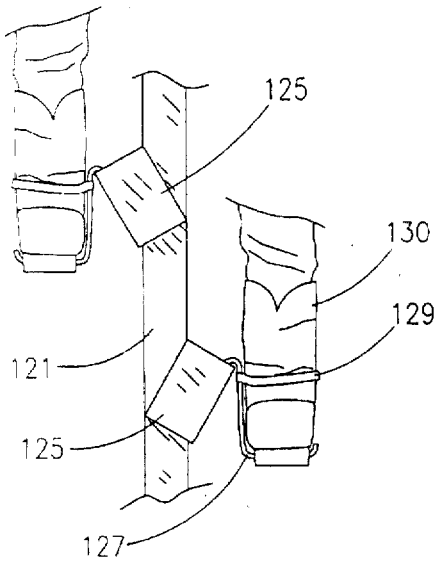
Figure 29:
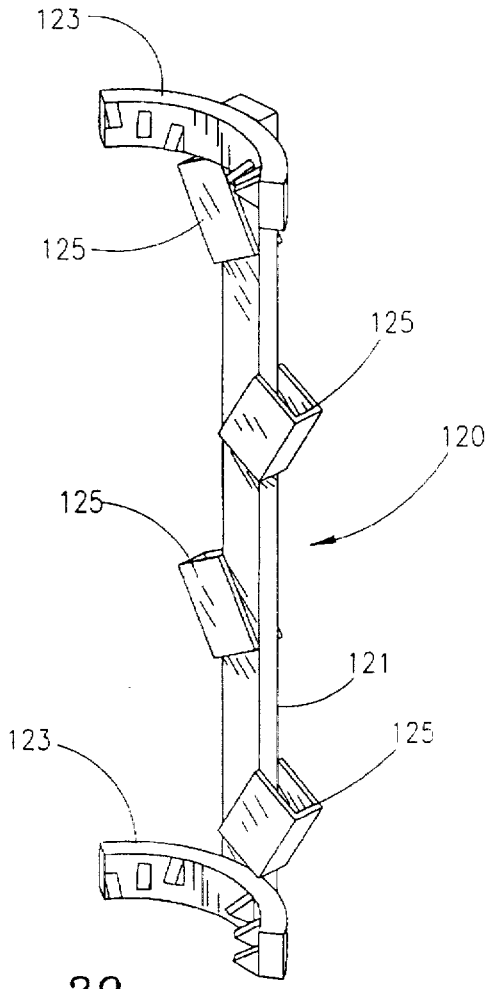
Figure 30:
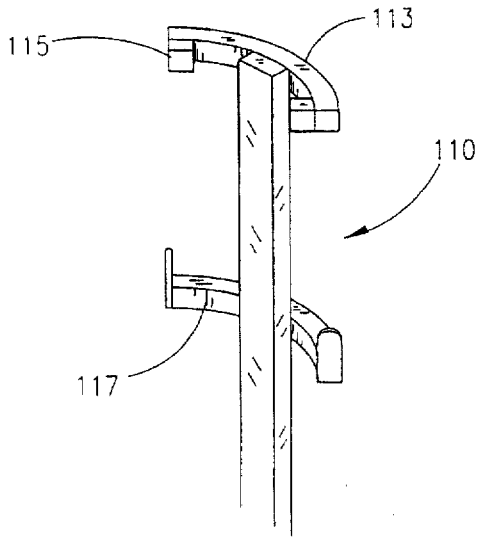
Figure 31:
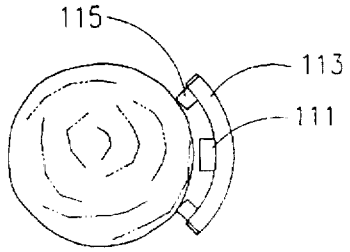
Figure 32:
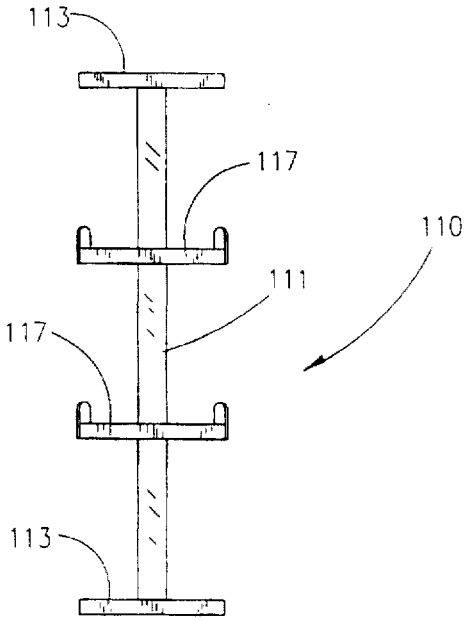

FIG. **26*a* is a partial side elevation of the stand off pivotal arrangement shown in FIG. 26**;

FIG. 27 is a side elevation view of FIG. 26 embodiment shown attached to a tree;

FIG. 28 is partial front elevation view of a climber having hooks attached to each foot for use with the embodiment shown in FIG. 29;

FIG. 29 is an isometric view of an alternative single rail ladder embodiment for use according to FIG. 28;

FIG. 30 is an isometric view of an alternative single rail ladder embodiment utilizing curved steps;

FIG. 31 is a top view of the ladder embodiment shown in FIG. 30;

FIG. 32 is a front elevation view of the FIG. 30 embodiment.

DETAILED DESCRIPTION OF THE PREFERRED EMBODIMENT

Figure 5:
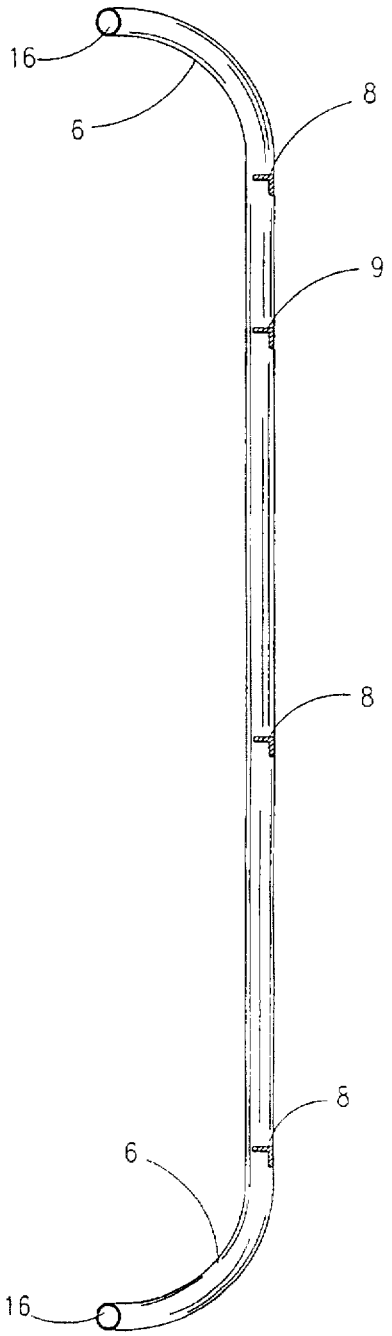
FIG. 5 is a section view of the preferred embodiment taken along line 5—5 in FIG. 4.
Figure 6:
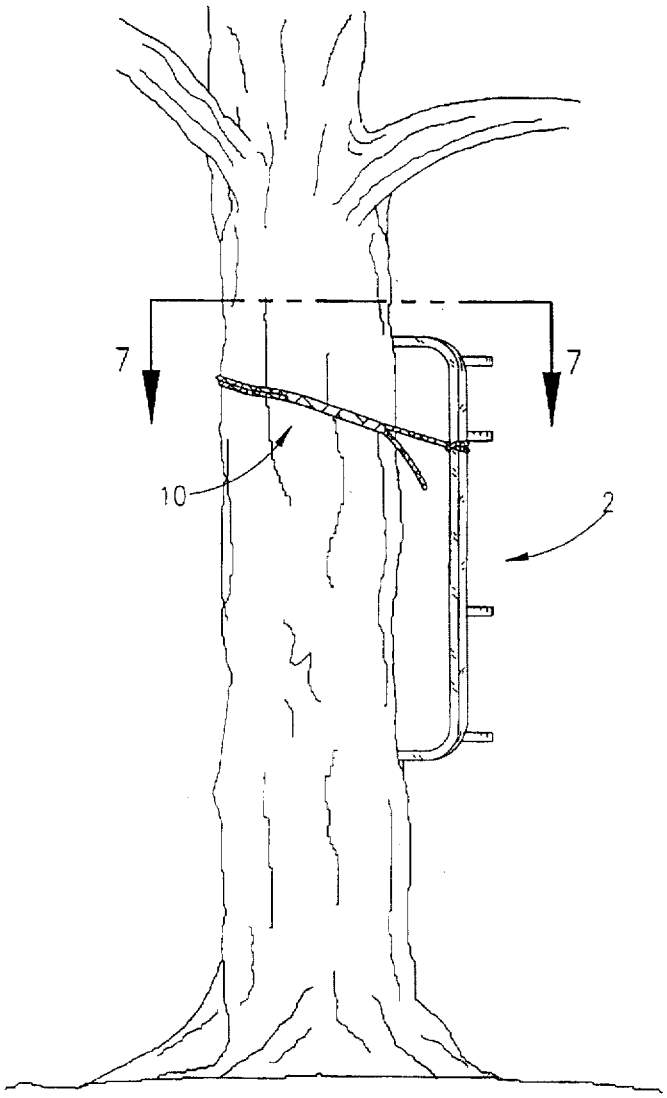
FIG. 6 is a front elevation view of an alternative embodiment of the present invention shown with bowed rungs.
Figure 7:
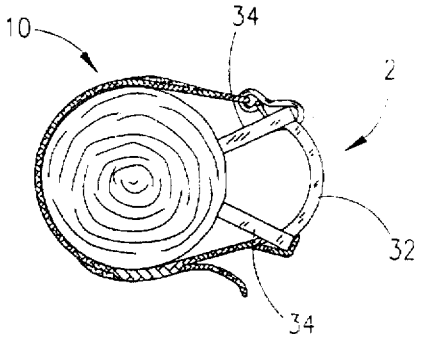
FIG. 7 is a cross section view of the FIG. 6 embodiment taken along sight line 7—7.

The preferred tree ladder embodiment 2 as seen in FIGS. 1–5 comprises a pair of tubular elongated rails 4 bent at each end 6 forming a generally "C" shape configuration best seen in FIG. 5. Rungs 8 are interposed between the rails 4 for securing the rails 4 in a generally juxtaposed, parallel relationship only wide enough for one foot. Each rail 4 is rotated in a manner so that its ends 16 converge with the ends 16 of the opposite rail at approximately 30 degrees off vertical as viewed in the horizonal plane, best seen in FIG. 3. Three rungs or steps 8 are provided spaced equal distance starting at the mid-point of the rails 4. An extra rung 9 is provided at one end of the ladder 2 below the outer most rung 8. This extra rung 9 and its unequal spacing allows the climber to change foot position readily. Since the preferred tree ladder 2 is only wide enough for one foot between the rails 4, foot position becomes a problem when traversing from the top rung 8 to another ladder or to a tree stand. Therefore, to prevent leg crossing, the climber need only descend to the center rung 8, by utilizing the intermediate rung 9, foot position may be reversed. This procedure prevents the necessity of the climber descending to ground level to change foot sequence. Additional benefit is gained, with the use of the top rung 8 and the intermediate rung 9 being relatively close together thus providing a more stable foot support when standing at the maximum elevation at the top of the ladder 2. The generally "C" shaped configuration of the rails 4 provides stand-off capability for the ladder thus allowing for foot clearance between the ladder 2 and the tree 7. However, additional clearance may be gained by bending the rungs 8,9 in a bowed or curved manner as seen in FIGS. 6, and 7. This configuration further allows the ends of the rungs 8,9 to be cut square when square, rectangular, or triangular tubing rails are used, thus reducing manufacturing cost.

Figure 1:
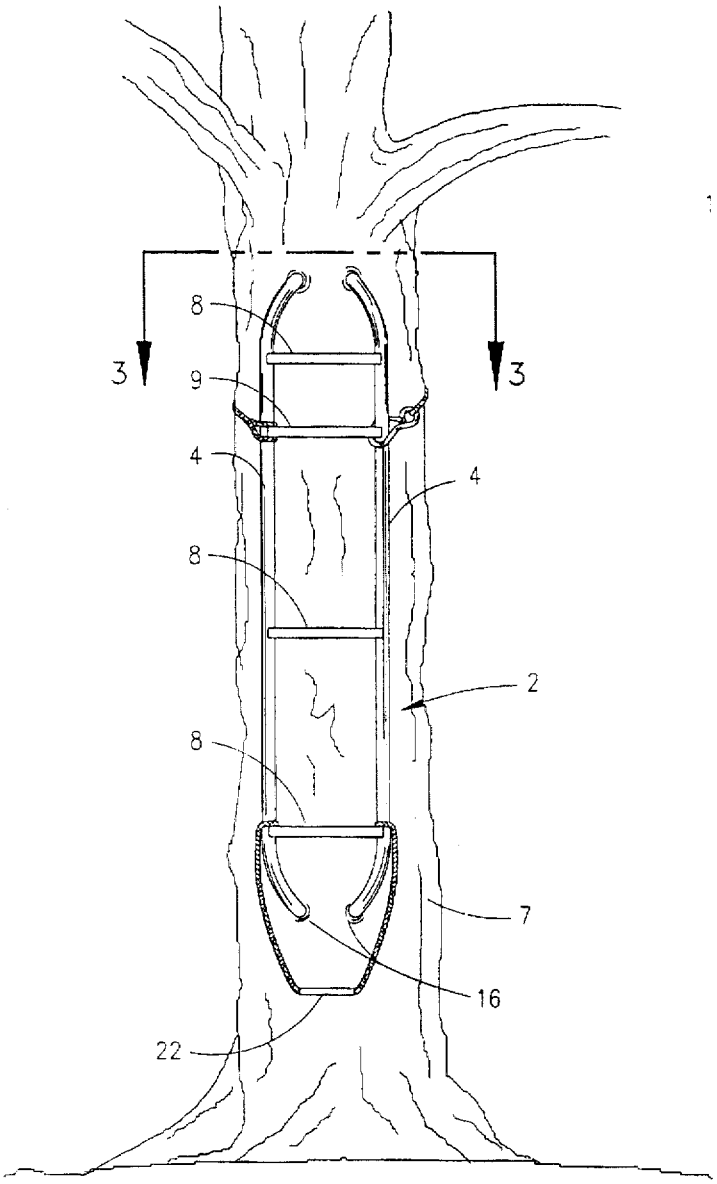
FIG. 1 is a front elevation view of the preferred embodiment shown attached to a tree.
Figure 2:
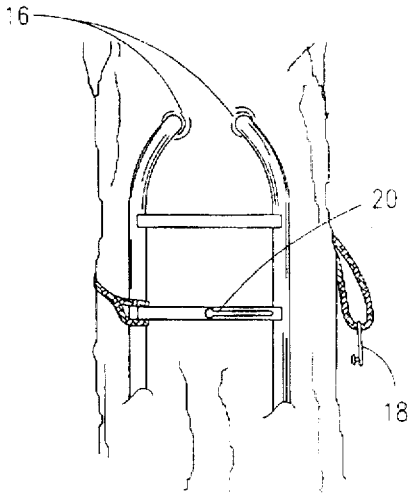
FIG. 2 is a partial front elevation view of the preferred embodiment showing an alternative rope attachment.
Figure 3:
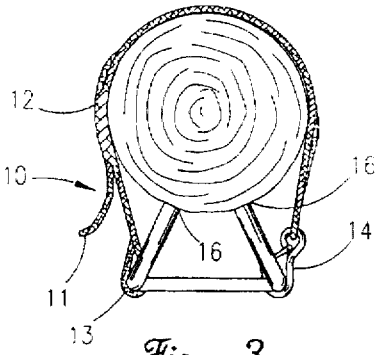
FIG. 3 is a cross-section view of the preferred embodiment taken along line 3—3 in FIG. 1.
Figure 4:
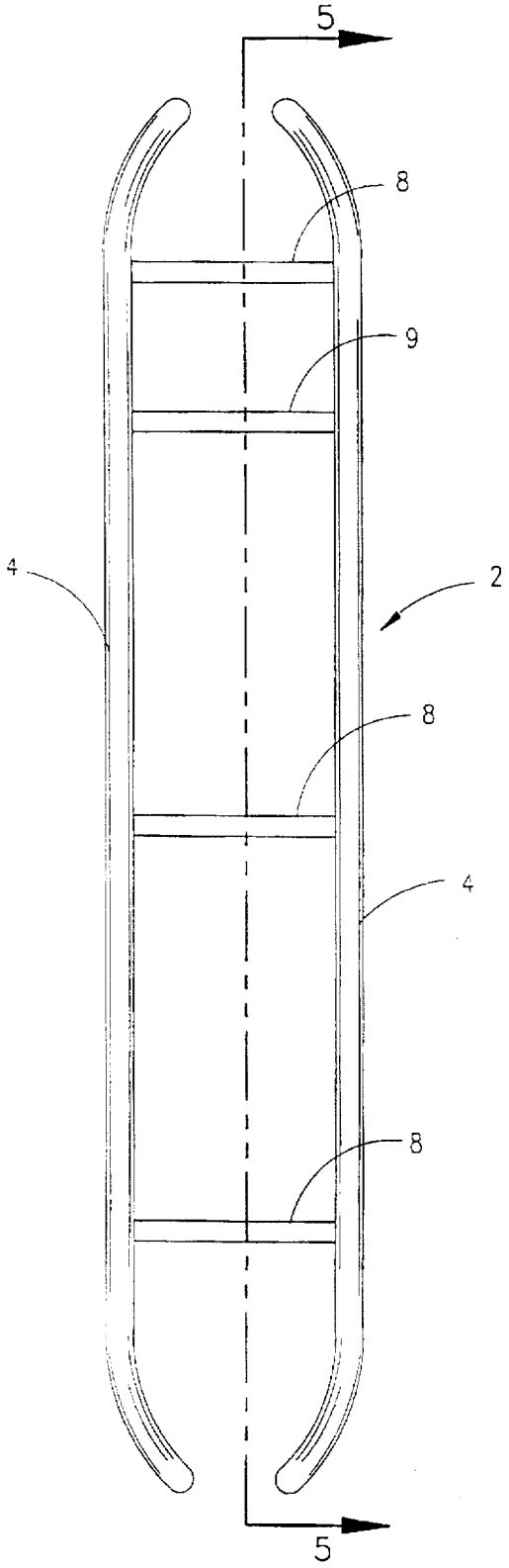
FIG. 4 is a front elevation view of the preferred embodiment.
Figure 22:
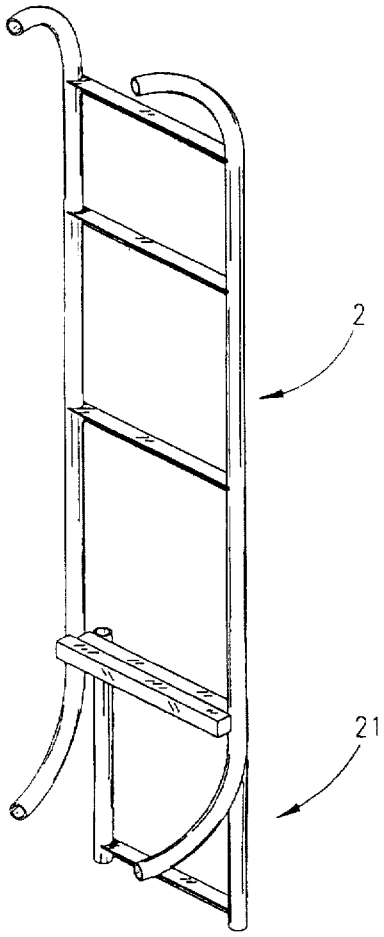
FIG. 22 is an isometric view of the preferred embodiment shown with an interlocking lower step attachment.
Figure 23:
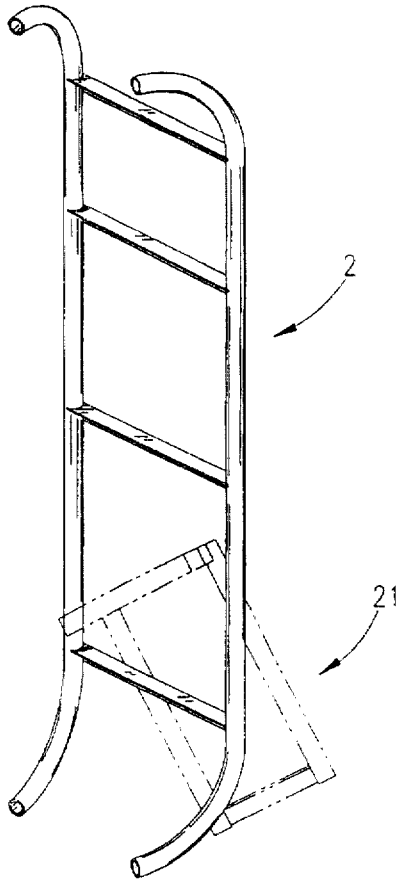
FIG. 23 is an isometric view of FIG. 22 showing the lower step being inserted.

As seen in FIG. 3, a rope or belt 10 is secured at one end 13 to one rail 4 at a point located between the mid point of the ladder and the uppermost rung 8. In any case it should be located at or below the intermediate rung 9. This allows for maximum compression of the "C" shaped rails 4 against the tree 7 when a climber's weight is on the ladder 2. The rope or belt 10 is passed through the retaining eye of a snap hook 14 and then passed though a cinch means 12. When the rope or belt 10 is passed around a tree 7, and the snap hook 14 is snapped around the opposite rail 4 at or below the intermediate rung 8 approximately one-third the ladder's length, and the rope's end 11 is cinched tightly due to being passed through the weave of the rope 10, a cantilevering effect is achieved. Therefore, any weight applied to the ladder 2 tightens the cinch 12 and is transferred downward and towards the tree 7, holding the ends 16 of the ladder 2 in a very secure position against the tree 7. Alternative hook types can be used with the rope 10 attachment for connection to the ladder 2. One such arrangement can be seen in FIG. 2, 10 in which a connector 18 attached to the rope is fitted into a slot 20 in the step 57 in a manner similar to that of a door security chain latch. It has been found that right angle rungs 8,9 as seen in FIG. 5 provide a secure foot grip and are structurally efficient. An optional feature seen in FIG. 1 provides a flexible stirrup 22 attached to each of the side rails 4 just above the lowermost rung 8. A variation of this concept can be seen in FIGS. 22 & 23 whereby a ridged step section 21 is provided for interlocking over the lower rung 8. Looking now at FIG. 6, & 7, we see that the tree to ladder step distance can be improved while maintaining side rail configuration. We also find that a savings in manufacturing cost can be achieved as a result of using square tubular rails 34 and rungs 32 being bent or curved outwardly. The rungs conforming more naturally with the curve of the tree can be cut with perpendicular ends Thus the manufacturing cost savings.

Figure 8:
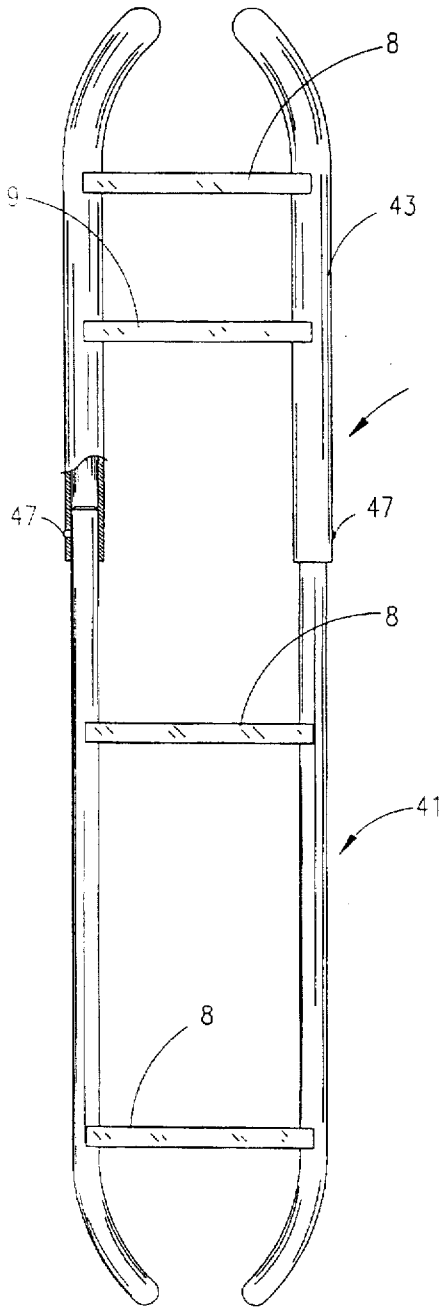
FIG. 8 is a front elevation view of an alternative embodiment utilizing a telescopic arrangement.
Figure 9:
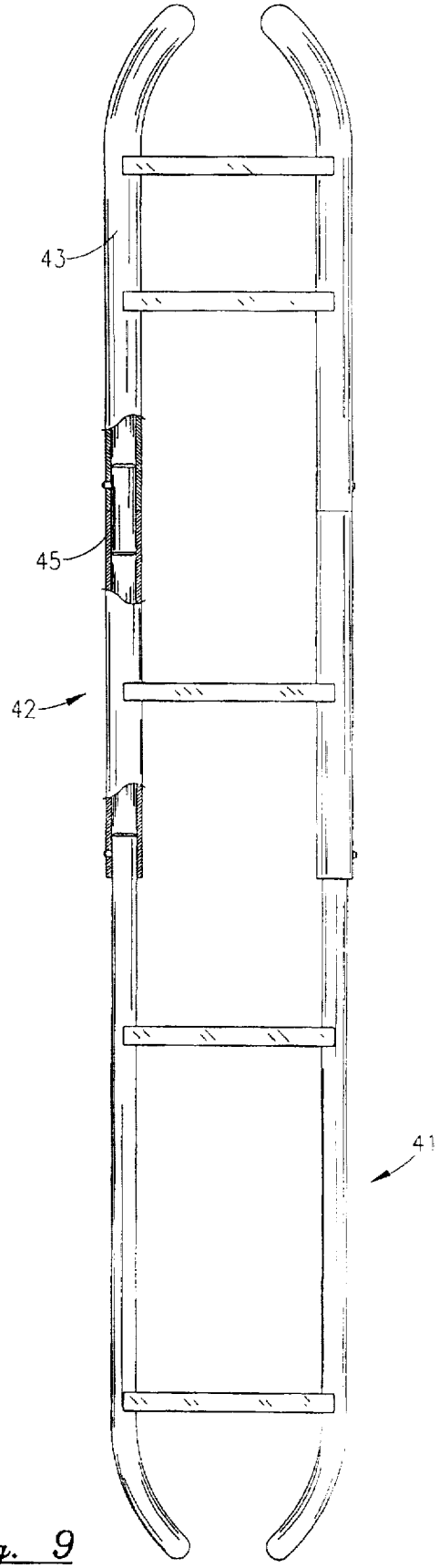
FIG. 9 is a front elevation view of an alternative embodiment utilizing a telescopic extension section.

Turning now to FIG. 8, we find a method of reducing the ladder structure 40 to an even more compact configuration by having the lower section 41 telescope from within the upper section 43. A snap lock 47 means is provided for maximum adjustment. FIG. 9 also utilizes the telescopic features of ladder structure 40 shown in FIG. 8 by providing an intermediate extension section 42, thereby retaining the same overall length when extended but making the ladder more compact for carrying. The intermediate section 42 has a stub 45 extending from one end for insertion into the upper section 43 the opposite end then telescopically receives the lower section 41.

Figure 10:
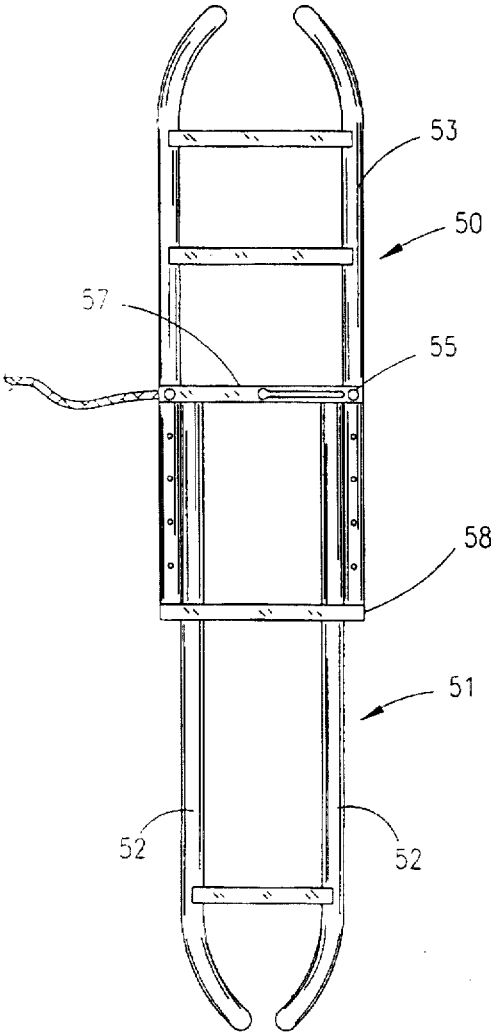
FIG. 10 is a front elevation view of an alternative embodiment utilizing a slidable adjustable, two section, interlocking arrangement.
Figure 11:
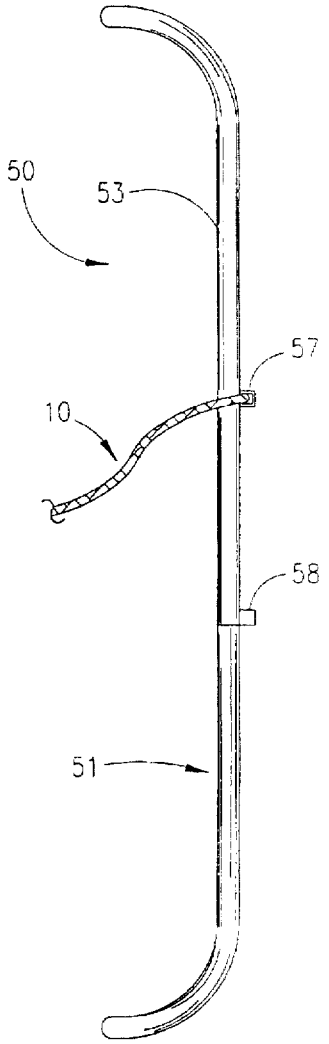
FIG. 11 is a side elevation view of the FIG. 10 embodiment.
Figure 12:
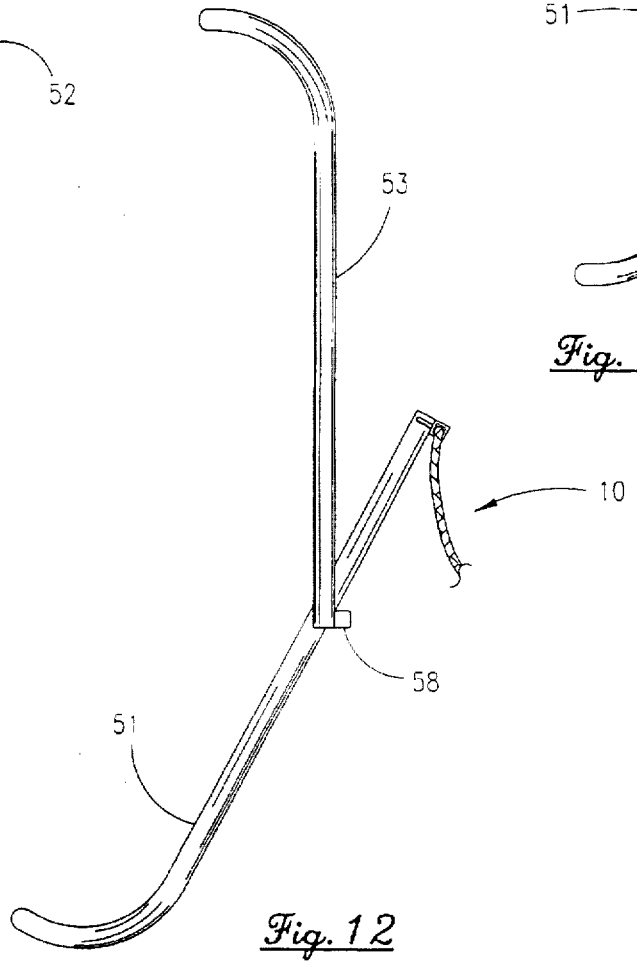
FIG. 12 is a side elevation of the FIG. 10 embodiment showing the lower section being inserted between the rails of the upper section that is inter-lockable with the lower rung.

Yet another alternative can be achieved as shown in FIGS. 10–12. Comprised of upper and lower sections 50 & 51 having the same rung or step spacing as that of the preferred embodiment 2. However the lower section 51 is incrementally adjustable relative to the upper section 50. The uppermost rung 57 of the lower section 51 over hangs its side rails 52. Upper section 50 is configured to allow the lower section 51 to be twisted slightly and inserted from the rear of upper section 53 over the lower rung 58 of the upper section 50 and rotated back to its original position, forming an interlocking arrangement between the two sections. The lower section 51 can be pinned via pins 55 at each side rail 53, or the lower section 51 can be allowed to slip to its lowest position, whereby rung 57 is in contact with rung 58. The cinch strap, rope, chain, or cable 10 is secured to one end of rung 57 with its latch hook attached to the opposite end of rung 57. It is essential that the attachment rope 10 be secured to the side rails 53, of the upper section 50, at a point between rung 58 and the next higher rung.

Figure 13:
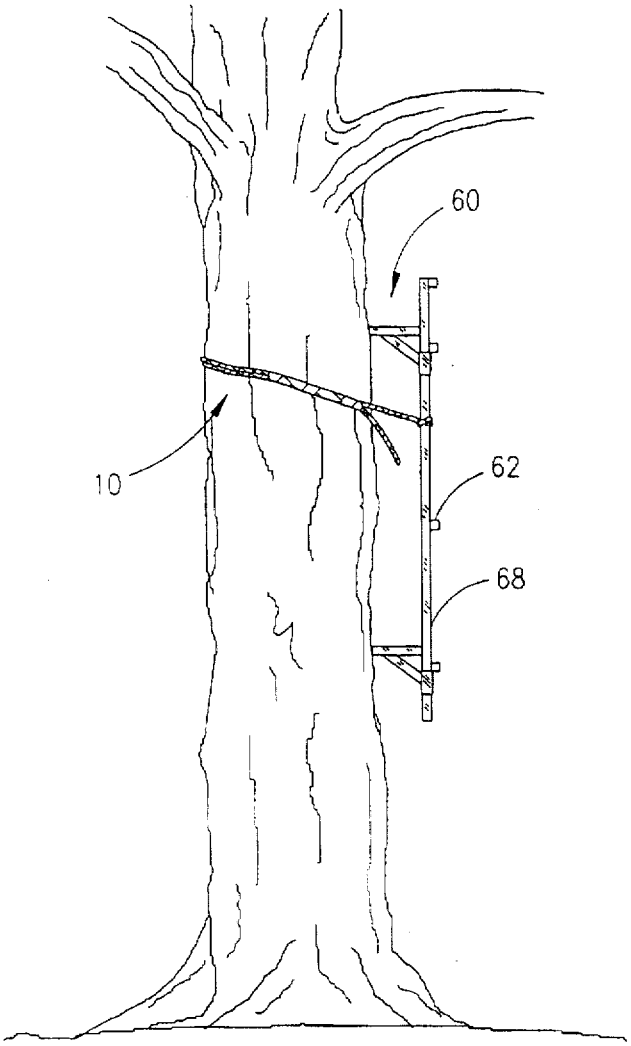
FIG. 13 is a side elevation view of an alternative embodiment of the present invention, utilizing fold and lock standoff legs.
Figure 14:
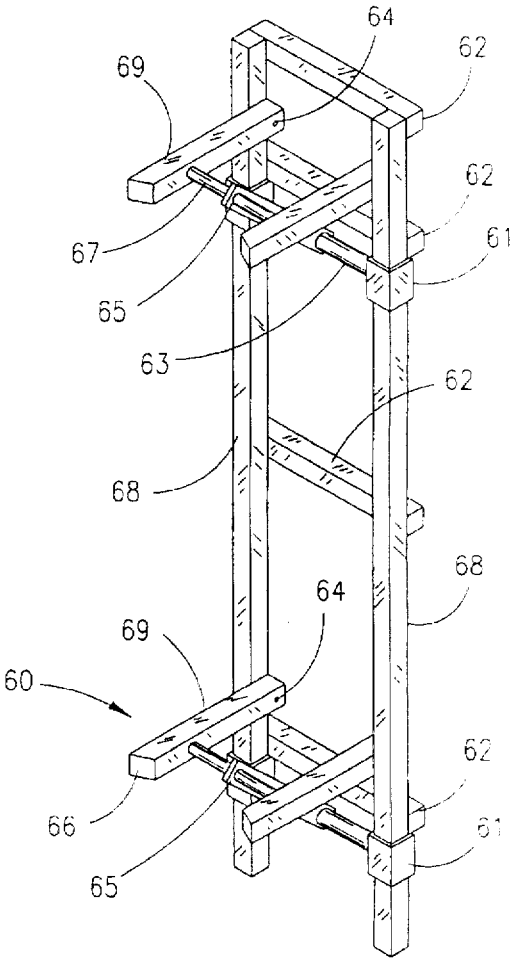
FIG. 14 is an isometric view of the alternative embodiment shown in FIG. 13.

Turning now to FIGS. 13 & 14, we see a still further means of activating and securing a set of stand-off legs. This retractable stand-off leg arrangement 60 is achieved by pivotally, via pin 64, attaching a pair of legs 69 with opposing bevels 66 at one end to the inside of a pair of side rails 68. The rails 68 are then held apart by rungs 62 attached to the outer face of the side rails 68. A sleeve 61, slidable along each of the side rails 62, is located below the lowermost rung 62 and below the second rung from the top. A connecting bar 63 is attached horizontally to each pair of slidable sleeves 61. Likewise, a bar 67 is attached horizontally to each pair of legs 69 near their beveled ends. A pivotal connecting strut 65 connects both horizonal bars 63, 67. Therefore, when the legs 69 are raised from their first compact position to the extended position, the strut 65 forces the horizonal bar 63 connecting the slidable sleeves 61 to slide upward until they contact the rungs 62. When weight is applied to the ladder in a downward direction, each leg assembly 60 is thereby held in a securely locked position.

Figure 19:
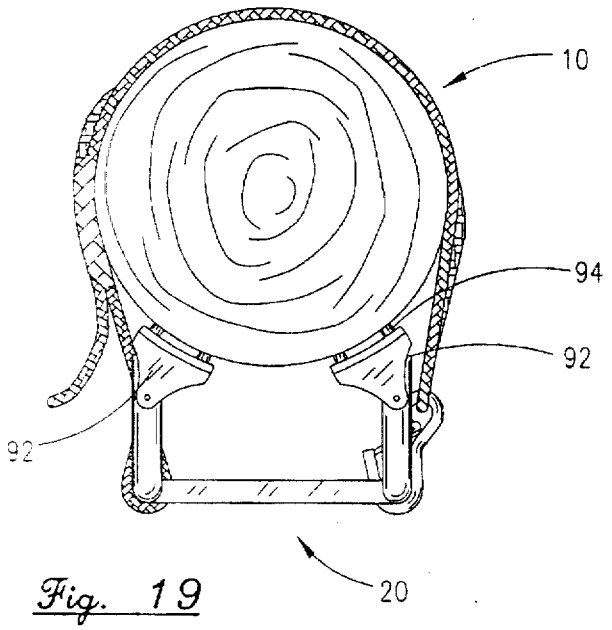
FIG. 19 is a cross section view of a tree ladder having parallel side rails but utilizing pivotal cleats for contacting the tree thus emulating the oblique contact points of preferred embodiment.
Figure 21:
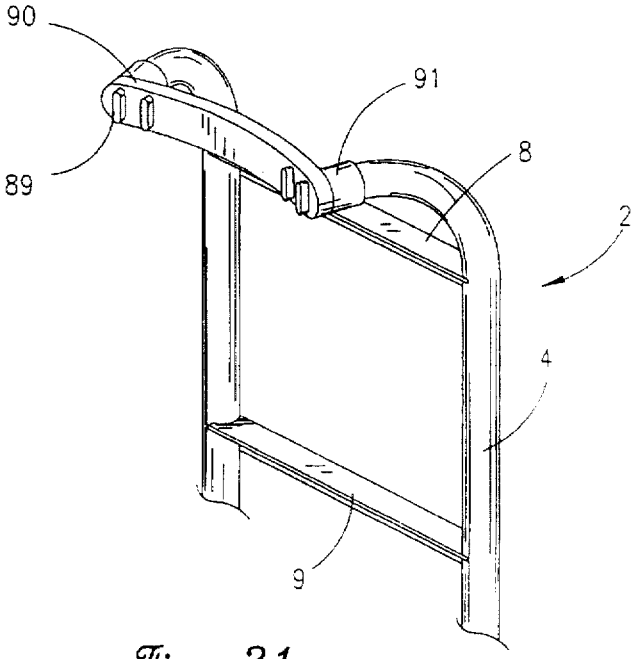
FIG. 21 is a molded polymer cleat used as anti-marring device with the preferred embodiment shown in FIGS. 1–5.

The use of flexible materials such as that shown in FIG. 21, to prevent marring of the tree 7, as previously discussed such flexible materials also provides a more positive grip on the tree when fitted to tree ladders using the radiused side-rail stand-off concept. In the arrangement of FIG. 21, a flexible material is molded into a concave shape having sockets 91 adaptable to the ends 16 of the preferred embodiment 2. However, such contoured members may be adapted to the other embodiment as well. Cleats 89 are also provided to help prevent lateral slippage. In FIG. 19, we see the side rails of a tree ladder 20 can be left essentially parallel thus the ends 16, which provide stand-off spacing between the tree 7 and the rungs 8,9, would normally intersect small trees in a manner which tends to spread the side rails 4. This arrangement, can be adapted to the more oblique contact configuration employed by the preferred embodiment 2, simply by attaching contoured pivotal shoes 92 to each of the side rail's ends 16. The contoured pivotal shoes 92 may be fitted with a flexible material 94 having griping cleats 89 projecting from its face thus preventing marring of the tree. Since the shoes 92 are pivotal, they tend to seek their own configuration when applied to the tree. However, pivotal travel is limited to prevent lateral rotation.

Figure 17:
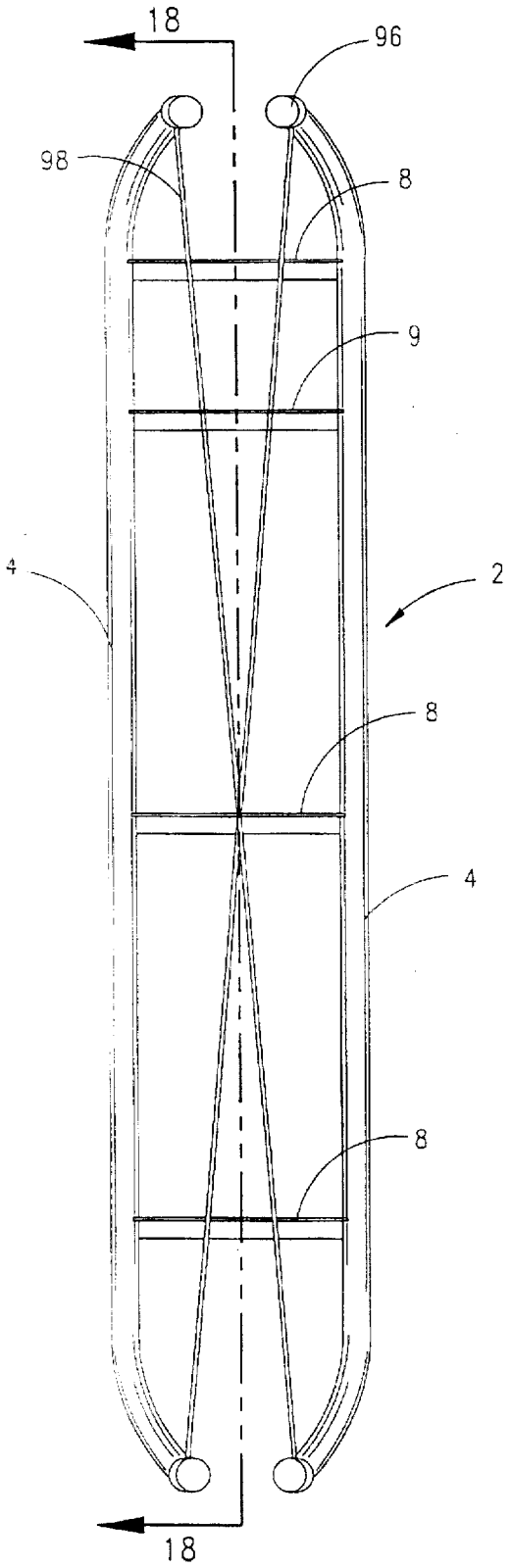
FIG. 17 is a rear elevation view of the preferred embodiment utilizing tension cables.
Figure 18:
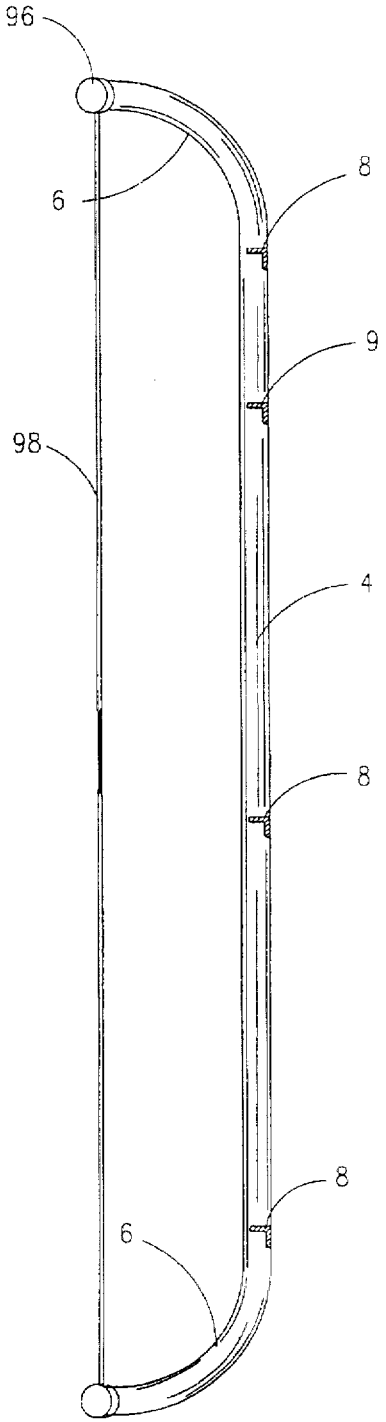
FIG. 18 is a cross-section view of the embodiment shown in FIG. 17 as seen along sight line 18.
Figure 20:
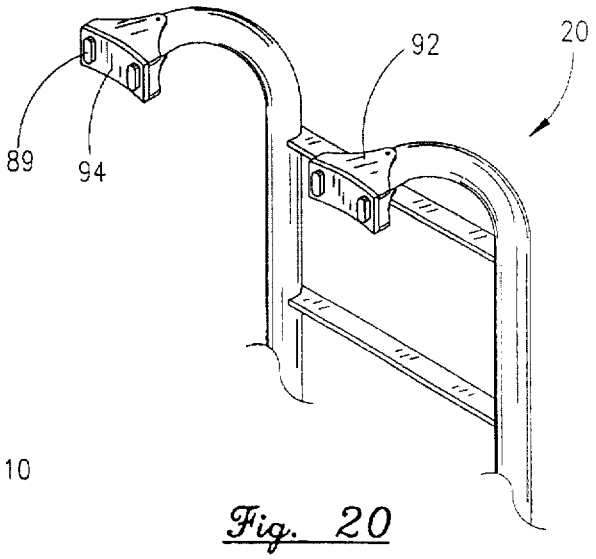
FIG. 20 is a partial isometric view of the FIG. 19 embodiment.

A less expensive anti-marring cap can be provided for the preferred embodiment 2 as seen in FIGS. 17 & 18. A set of tube caps 96 attached together by a cable 98 is provided for covering each of the side-rail's ends, thereby preventing marring of the tree. The cable 98 further serves as structural bracing to prevent spreading of the rail ends.

Figure 15:
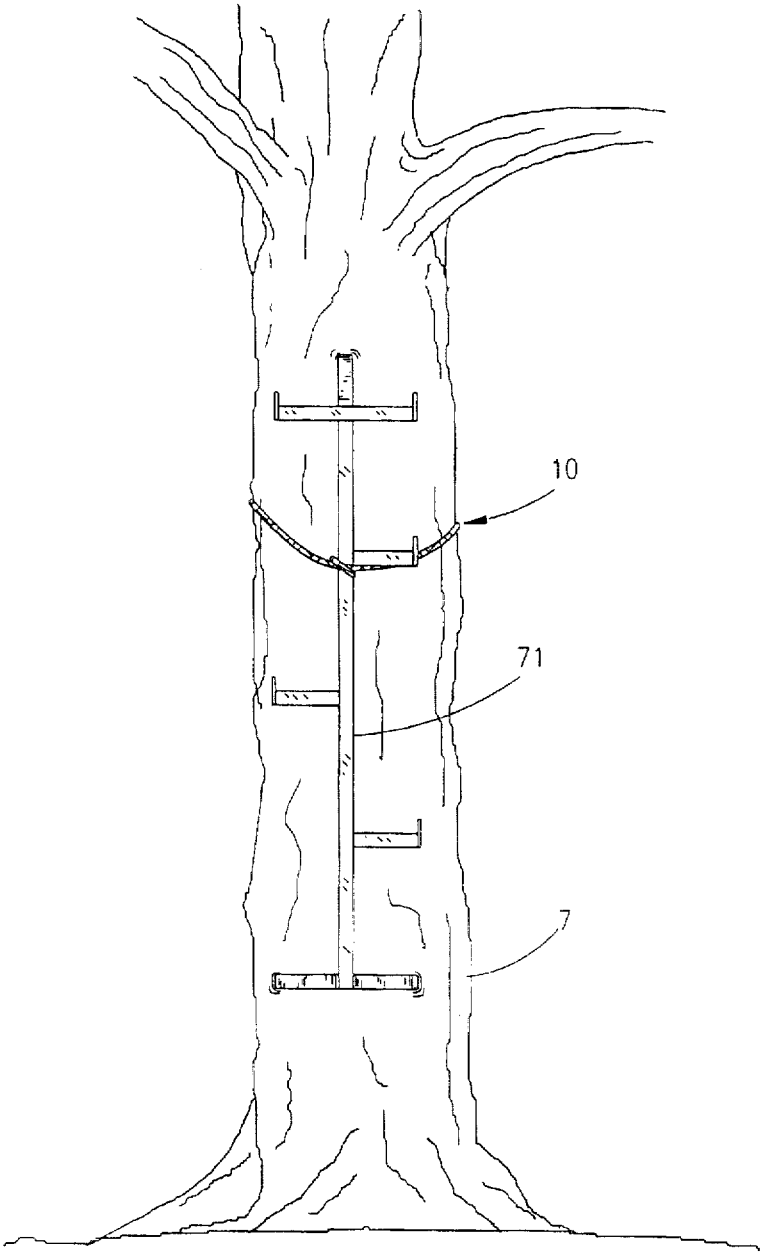
FIG. 15 is a front elevation view of an alternative embodiment of the present invention utilizing a single rail with alternating steps.
Figure 16:
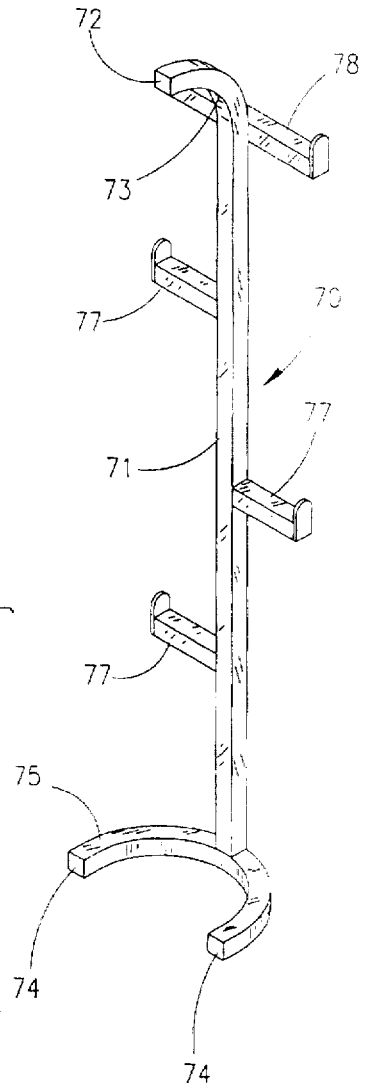
FIG. 16 is an isometric view of the embodiment shown in FIG. 15.

The concept of the present invention can be practiced in yet another embodiment as seen in FIGS. 15 a 16. This arrangement 70 utilizes a pole type ladder comprising a single vertical column 71 having a large radius 73; a semi-circular "U" shaped member 75 attached perpendicular to the vertical column 71 opposite the radius; and steps 77 attached at alternating positions along each side of the vertical column 71. The end 72 of the vertical column 71 nearest the radius 73 and the ends 74 of the semi-circular "U" shaped member 75 provide a three point contact with the tree 7 thus providing the necessary stand-off for foot clearance. A single cross member 78 is attached near column radius 73 which serves as both handle bar and upper most step. The "U" shaped member 75 further serves as a foot step. A chinch strap 10 is also secured below the upper most step 77 again located at approximately one third the length of the ladder 70. It is obvious that this ladder arrangement 70 would work equally as well in the reversed position when placed on the tree 7 or by providing a "U" shaped member at both ends of the vertical column 71.

Figure 24:
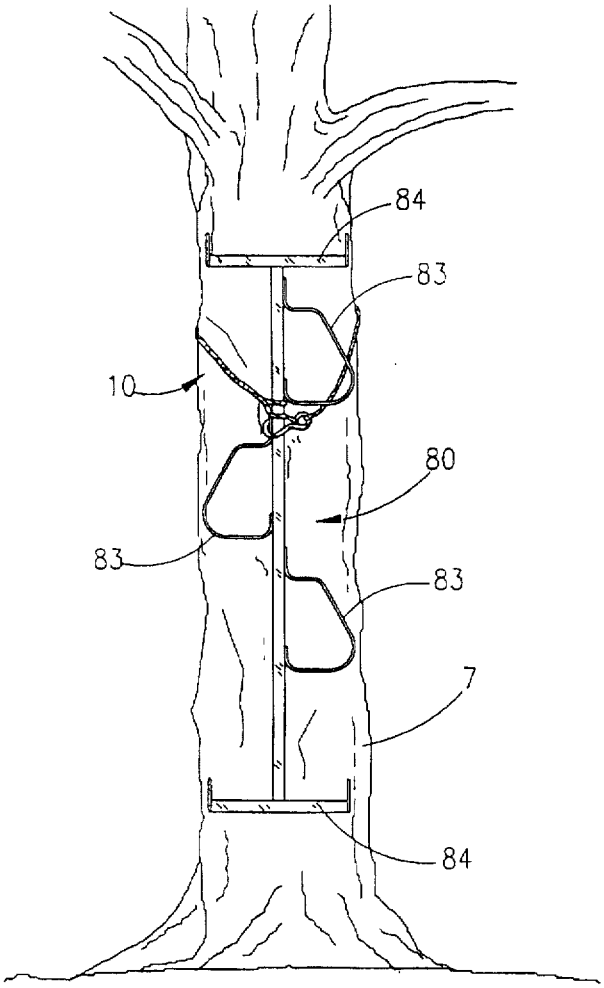
FIG. 24 is a front elevation view of an alternative single rail ladder having stirrup type steps.
Figure 25:
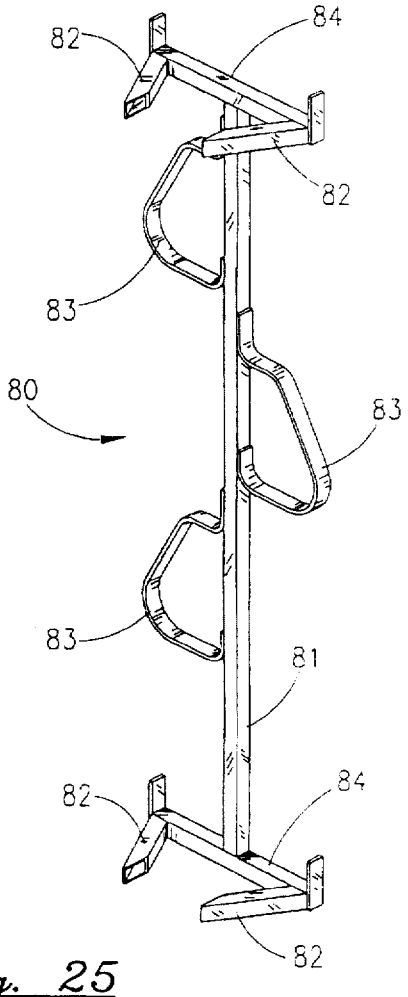
FIG. 25 is an isometric view of the embodiment shown in FIG. 24 and showing oblique angled stand-off legs.

Stick or pole ladders can be provided in several configurations utilizing the dual short ladder concept. In FIG. 24 a 25 another embodiment 80 utilizing the pole ladder concept is shown comprising a vertical column 81; cross-members 84 attached at either end of 30 the vertical column 81 having oblique angled stand off members 82; and loop steps attached to alternately along each side of the vertical column 81. The loop steps 83 insure positive footing by the climber.

Figure 26A:
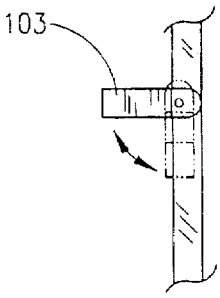

In FIGS. 26–27 a pole ladder structure 100 is provided which comprises a single vertical column 101; pivotal semi-circular stand-offs 103 located near the top and bottom of the vertical column 101; and folding steps 105 located alternately along either side of the vertical column 101. Again we see the single strap 10 connected to the pole or column 101 below the second step 105 from the top, insuring maximum contact with the tree when the climber's weight is placed on the ladder 100. Such semi-circular stand-offs 105 can be provided with serrated teeth as seen in FIG. 26 or can be supplied with protective anti-slip flexible members similar to that seen in FIG. 21 thus providing contact points at diagonals with the vertical column 101. The semi-circular stand-offs 103 can be ridged or pivotally mounted as shown to allow for more compaction during transport. If pivotally mounted the stand offs 103 must be pivoted downward only as seen in FIG. 26A. Pole ladder steps can be provided with fixed steps as seen in FIGS. 30–32 or with flip up steps shown in FIG. 26. Either of which may be provide with serrated edges, as shown on steps 105, for positive foot grip.

Another pole ladder embodiment utilizing a more ridged stand-off and foot step arrangement can be seen in FIGS. 30–32. This structure 110 comprises a single vertical column 111; curved tubular members 113 attached at each end of the vertical column 111; additional curved tubular members 117 attached at regular spacing along the length of the vertical column 111; and contact legs 115 positioned on oblique angles with the vertical member attached to the curved member 113. All curved members 113, 117 serve as steps. It should be noted that a variety of step locations can provided with this configuration. Variations may include alternating curved tubular members along each side of the vertical column as shown in other version of the pole ladder. The number of steps 117 can be varied as well.

A more unique approach to climbing such pole ladders can be seen in FIGS. 28 & 29. In these Figures we see a structure 120 comprised of a single vertical column having semi-circular stand-offs 123 attached at each end of the vertical column 121 with griping teeth and a series of channels 125 alternately attached to the vertical column 121 a acute angles. This arrangement provides cleat wells for hooks 127 worn by the climber 130 seen in FIG. 28, thus eliminating the need for protruding steps. The semi-circular stand offs 123 may be made rotatable to aline with the vertical column for transport and storage or be disassembled.

What is claimed is:

1. A portable hunting ladder for use in climbing trees comprising:

a) a pair of elongated tubular side rails of substantially equal length, each of said side rails being bent in a generally "C" shape, and whereas said elongated tubular side rails are held in a spaced apart, substantially parallel relationship at distance larger than a typical hunter's boot and less than twice such width, by;

b) a plurality of spaced apart, ladder rungs, interconnecting said side rails along their length, said rungs being curved in an arc parallel to the arc of the outside surface to a tree to which the ladder is attached;

c) a flexible means for tightly encircling a tree, with said flexible means affixed to said ladder generally between the mid-point of said ladder and next adjacent rung, thereby supporting said hunting ladder when suspended from a tree, said flexible means being placed in substantial tension at such time as said tree has been encircled and weight exerted on said ladder rungs.

2. A portable hunting ladder according to claim 1 wherein said ladder rungs further comprise at least three rungs located at regular spacings starting at the mid-point of said ladder, having at least one upper and lower rung located either side of said mid-point, and at least one ladder rung being an intermediate rung unequally spaced located between said mid-point and said upper rung.

3. A portable hunting ladder according to claim 1 wherein said ladder further comprises a flexible member attached to said side rail's ends to prevented marring of said tree when said tree ladder is in suspended contact with said tree.

4. A portable hunting ladder according to claim 1 wherein, said ladder further comprises a detachable flexible stirrup for extending said ladder's length.

5. A portable hunting ladder according to claim 1 wherein said flexible means is attached to said next adjacent rung.

6. A portable hunting ladder for use in climbing trees comprising:

a) an upper section having a pair of elongated tubular side rails of substantially equal length, each bent in a generally "L" shape, and whereas said elongated tubular side rails are held in a spaced apart, substantially parallel relationship at a distance larger than a typical hunter's boot and less than twice such width, with their ends rotated at oblique angle towards each other, by;

b) a plurality of spaced apart, ladder rungs interconnecting said side rails along their length, said rungs being curved in an arc parallel to the arc of the outside surface to a tree to which the ladder is attached;

c) a flexible means for tightly encircling a tree, with said flexible means affixed to said upper section at a point between the mid-point of said ladder and next adjacent rung, thereby supporting said ladder when suspended from a tree, said flexible means being placed in substantial tension at such time as said tree has been encircled and weight exerted on said ladder rungs by said hunter;

d) a lower section having a pair of elongated tubular side rails of substantially equal length, each bent in a generally "L" shape, and whereas said elongated tubular side rails are held in a spaced apart, substantially parallel relationship, at a distance sufficient to extend between and fictionally engage said upper section's side rails;

e) a first ladder rung, interconnecting said lower section's side rails, adjacent their bent ends; and f) a second ladder rung, interconnecting said lower section's side rails opposite said bent ends, extending a sufficient distance on either side to interlockingly engage said upper section's side rails.

* * * * *